US011439188B2

(12) United States Patent
Lin et al.

(10) Patent No.: US 11,439,188 B2
(45) Date of Patent: Sep. 13, 2022

(54) AUTOMATICALLY CONTROLLED HEAT-NOT-BURN ELECTRONIC CIGARETTE DEVICE AND CONTROL METHOD THEREOF

(71) Applicant: SHENZHEN HAPPY VAPING TECHNOLOGY LIMITED, Guangdong (CN)

(72) Inventors: Guangrong Lin, Guangdong (CN); Xianbin Zheng, Guangdong (CN); Xiyong Zhang, Guangdong (CN)

(73) Assignee: SHENZHEN HAPPY VAPING TECHNOLOGY LIMITED, Shenzhen (CN)

( * ) Notice: Subject to any disclaimer, the term of this patent is extended or adjusted under 35 U.S.C. 154(b) by 283 days.

(21) Appl. No.: 16/914,468

(22) Filed: Jun. 29, 2020

(65) Prior Publication Data

US 2020/0323273 A1 Oct. 15, 2020

Related U.S. Application Data

(63) Continuation of application No. PCT/CN2019/072115, filed on Jan. 17, 2019.

(30) Foreign Application Priority Data

Jan. 12, 2018 (CN) ..... 201810031237.4

(51) Int. Cl.

| | |
|---|---|
| ***A24F 13/00*** | (2006.01) |
| ***A24F 40/50*** | (2020.01) |
| ***A24F 40/53*** | (2020.01) |
| ***A24F 40/90*** | (2020.01) |
| ***A24F 40/46*** | (2020.01) |
| ***A24F 40/57*** | (2020.01) |
| ***A24F 40/60*** | (2020.01) |

(Continued)

(52) U.S. Cl.

CPC ..... *A24F 40/50* (2020.01); *A24F 40/40* (2020.01); *A24F 40/46* (2020.01); *A24F 40/53* (2020.01); *A24F 40/57* (2020.01); *A24F 40/60* (2020.01); *A24F 40/90* (2020.01); *A24F 40/20* (2020.01)

(58) Field of Classification Search

CPC ..... A24F 47/00
USPC ..... 131/328–329
See application file for complete search history.

(56) References Cited

U.S. PATENT DOCUMENTS

| | | | | |
|---|---|---|---|---|
| 2015/0136158 A1* | 5/2015 | Stevens | A61M 15/06 | 131/329 |
| 2016/0157524 A1* | 6/2016 | Bowen | G01N 33/0027 | 702/50 |
| 2017/0231283 A1* | 8/2017 | Gadas | A24F 7/02 | 131/329 |

* cited by examiner

*Primary Examiner* — Phuong K Dinh

(57) ABSTRACT

The disclosure provides an automatically controlled heat-not-burn electronic cigarette device and a control method thereof. The electronic cigarette device comprises a housing, a housing lid and a heating tube arranged in the housing, a heat-insulating tube, an automatic lid opening and/or closing mechanism, a cigarette detecting mechanism, an intelligent control circuit board, a button, and a battery. The intelligent control circuit board is arranged with a main control chip, a heating control module, an automatic lid opening and/or closing control module, a button control module, a detector control module, and a charging management module. The main control chip is configured to control the electronic cigarette device to enter a smoking operation mode, or a sleep state, or an off state, on the basis of the determination (Continued)

of whether a cigarette is received in the heating tube within a certain time.

10 Claims, 5 Drawing Sheets

(51) Int. Cl.
*A24F 40/40* (2020.01)
*A24F 40/20* (2020.01)

AUTOMATICALLY CONTROLLED HEAT-NOT-BURN ELECTRONIC CIGARETTE DEVICE AND CONTROL METHOD THEREOF

CROSS-REFERENCE TO RELATED APPLICATIONS

The present application is a Continuation Application of PCT application No. PCT/CN2019/072115 filed on Jan. 17, 2019, which claims the benefit of Chinese Patent Application No. 201810031237.4 filed on Jan. 12, 2018, the contents of the above are hereby incorporated by reference.

TECHNICAL FIELD

The disclosure relates to the field of electronic cigarettes, more particularly to an automatically controlled heat-not-burn electronic cigarette device and a control method thereof.

BACKGROUND

Generally, harmful substances such as tobacco tar, carbon monoxide, phenol, oxynitride, olefins and polycyclic aromatic hydrocarbons may be generated during the combustion of cigarettes. Such substances are severely harmful to the human body.

In order to allow the users to enjoy cigarettes without being harmed by the great amount of harmful substances that may be generated, the heat-not-burn cigarette devices are provided. The heat-not-burn cigarette devices available on the market may operate as follows. During using, the user may set a cigarette in the heat-not-burn cigarette device. The cigarette may be electrically heated and be roasted at a temperature below the combustion temperature, to generate smoke. Then, the users may enjoy the tobacco smoke. Such cigarette devices generate smoke by heating process instead of combustion process, thereby preventing the users from being harmed by the great amount of harmful substances which may be generated during the combustion process of cigarettes. Thus, such cigarette devices have been gradually and widely used.

Existing heat-not-burn cigarette devices have a low degree of automation and are not convenient to use. They require manual operations to manually activate the device, to manually open the lid, to artificially determine whether a cigarette is inserted, and to manually inactivate the device after use. Due to the absence of auto sleep function and auto turn off function, they continuously consume power even when being temporarily out of use, which may result in shorter service life.

SUMMARY

Technical Problem

An object of the disclosure is to provide an automatically controlled heat-not-burn electronic cigarette device. Another object of the disclosure is to provide a method of controlling an automatically controlled heat-not-burn electronic cigarette device.

Technical Solutions

A technical solution of the disclosure is as follows. An automatically controlled heat-not-burn electronic cigarette device comprises a housing, a housing lid and a heating tube arranged in the housing, a heat-insulating tube sleeved outside the heating tube, an automatic lid opening and/or closing mechanism, a cigarette detecting mechanism, an intelligent control circuit board, a button, and a battery. The housing lid is provided with a cigarette insertion port. The automatic lid opening and/or closing mechanism is arranged below the housing lid, comprises a cigarette insertion port lid and a drive motor for driving the cigarette insertion port lid to open or close the cigarette insertion port. The cigarette detecting mechanism comprises an upper holder, a detector circuit board, and a detector disposed on the detector circuit board. The upper holder is tube-shaped and is sleeved at an upper end of the heating tube and is located below the cigarette insertion port. A lower inner wall of the upper holder may abut an upper outer wall of the heating tube, and a lower outer wall of the upper holder may abut an upper inner wall of the heat-insulating tube. An upper wall of the upper holder is provided with a viewing window. The detector may be arranged outward of the viewing window, to detect whether a cigarette is received in the heating tube. The intelligent control circuit board is arranged with a main control chip, a heating control module, an automatic lid opening and/or closing control module, a button control module, a detector control module, and a charging management module. Herein, the heating control module is electrically connected with the heating tube, the automatic lid opening and/or closing control module is electrically connected with the drive motor, the button control module is electrically connected with the button, and the detector control module is electrically connected with the detector. The main control chip is configured to control the electronic cigarette device to enter a smoking operation mode, or a sleep state, or an off state, on the basis of the determination of whether a cigarette is received in the heating tube within a certain time.

Preferably, the viewing window may comprise a transmissive window for sealing the viewing window, and the detector can detect a cigarette through the transmissive window.

Preferably, the upper inner wall of the upper holder may have an inner diameter the same as an inner diameter of the heating tube, and the lower inner wall of the upper holder may have an inner diameter the same as an outer diameter of the heating tube. An end shoulder is provided on the outer wall of the upper end of the upper holder. A middle shoulder is provided on the middle part of the outer wall of the upper holder, and the outer wall below the middle shoulder may be sleeved on the heat-insulating tube.

Preferably, a heat-generating conductor is arranged inside the wall of the heating tube. The heating tube may be made of ceramic materials. The heat-generating conductor is serpentine line shaped or spiral shaped, and made of tungsten, graphite or graphene material arranged inside the wall of the heating tube.

Preferably, the detector may be an infrared detector.

Preferably, a vibrator may be further provided, which is configured to generate a vibration alert when the operational state of the electronic cigarette device is changed.

Preferably, an LED indicator may be arranged on an outer circumference of a surface of the button. The LED indicator may be configured to indicate information such as the operational state of the electronic cigarette device or a remaining amount of the battery. The LED indicator may comprise four segments of curved light zones. The four segments of curved light zones may constitute a complete annular zone.

In another technical solution provided by the disclosure, a method of controlling an automatically controlled heat-not-burn electronic cigarette device comprises steps of:

1. Receiving an activation signal by means of a main control chip when a button is quickly pressed N1 time;

2. Sending a command to an automatic lid opening and/or closing control module by means of the main control chip, and opening a cigarette insertion port to allow insertion of cigarette by means of the automatic lid opening and/or closing control module through an automatic lid opening and/or closing mechanism;

3. Sending a command to a detector by means of the main control chip, and by means of the detector, detecting whether a cigarette is received in a heating tube and feeding back a signal indicating whether a cigarette is received to the main control chip, hereafter, continuously detecting by means of the detector until entering a sleep state or an off state;

4. Determining, by means of the main control chip, whether a cigarette is detected by the detector, if yes, go to step 6; if no, go to next step;

5. Determining, by means of the main control chip, whether the time elapsed since the cigarette insertion port is opened exceeds T1 minute, if no, go back to step 4; if yes, go to step 15;

6. Sending a command to a heating control module by means of the main control chip, and by means of the heating control module, controlling the heating tube to enter a preheating mode and perform quick heating for T2 second;

7. Controlling, by means of the heating control module, the heating tube to enter a smoking operation mode, in which the heating tube performs heating to maintain constant temperature and the device is available for smoking operation;

8. In the smoking operation mode, by means of the main control chip, determining whether the button is quickly pressed N2 time, or determining whether an absence of a cigarette is detected by the detector, if yes, go to step 10; if no, go to next step;

9. Determining, by means of the main control chip, whether the time elapsed since entering the smoking operation mode exceeds T3 second, if no, go back and continue step 7;

10. Sending, by means of the main control chip, a stopping command to stop the smoking operation mode, and controlling, by means of the heating control module, the heating tube to stop heating;

11. Determining, by means of the main control chip, whether a cigarette is detected by the detector, if yes, go to next step; if no, go to step 15;

12. Determining, by means of the main control chip, whether the time elapsed since the smoking operation mode is stopped exceeds T4 minute, if no, go back to previous one step; if yes, go to next step;

13. Sending a sleep command by means of the main control chip, and entering a sleep state of the whole device, in which the automatic lid opening and/or closing mechanism is in a state of keeping the heating tube open, and the main control chip and all circuits are deactivated;

14. Determining whether the button is quickly pressed N3 time, or, whether the whole device enters a charging mode, if yes, reactivate the whole device and go to step 4; if no, go back to step 13;

15. Entering an off state, in which the heating tube is closed by means of the automatic lid opening and/or closing mechanism, and the main control chip and all circuits are deactivated.

Preferably, in the steps, N1, N2, N3 (the times that the button is quickly pressed) may be three, T1 may be 1 minute, T2 may be 24 seconds, T3 may be 3 minutes and 50 seconds, and T4 may be one minute.

Preferably, the electronic cigarette device may further comprise a vibrator and comprises an LED indicator arranged on an outer circumference of a surface of the button. The LED indicator may comprise an annular zone which comprises four segments of curved light zones. The step 7 and the step 10 may further comprise: providing short vibration for informing a user by means of the vibrator. The step 2 may further comprise: lighting segments of the annular zone of the LED indicator in a circular manner, to inform a user it is ready to receive a cigarette.

The step 6 may further comprise: on the basis of preheating time progress, lighting the four segments of curved light zones of the LED indicator one by one, to inform a user of the preheating progress.

The step 7 may further comprise: continuously lighting the annular zone of the LED indicator, to inform a user of entering the smoking operation mode.

The step 10 may further comprise: lighting in a circular manner and then un-lighting segments of the annular zone of the LED indicator, to inform a user that the smoking operation mode is terminated.

The step 13 may further comprise: blinking twice and then un-lighting the annular zone of the LED indicator, to inform a user of entering the sleep mode.

Advantages

The electronic cigarette device is provided with the automatic lid opening and/or closing mechanism for automatically opening and/or closing the cigarette insertion port. It is convenient to use and can prevent foreign matter from entering the heating tube. The device is provided with the cigarette detecting mechanism for automatically detecting whether a cigarette is received in the heating tube. The device is provided with the intelligent control circuit board for automatically controlling the smoking operation process. The main control chip is configured to control the electronic cigarette device to enter the smoking operation mode, or the sleep state, or the off state, on the basis of the determination of whether a cigarette is received in the heating tube within a certain time. It does not require manual operations to artificially determine whether a cigarette is inserted, or to manually inactivate the device after use. The device is convenient to use. When a user forgets to pull out the cigarette in the device which is temporarily out of use, it can enter the sleep state rather than initiate the forced shutdown. In such case, the automatic lid opening and/or closing mechanism, which would be prevented from being forced to close, would not clamp the cigarette. Thus, a failure can be avoided. The device can automatically determine to enter the sleep state or the off state, whereby continuous power consumption can be avoided, and service life of the electronic cigarette device can be increased.

Figure 1:
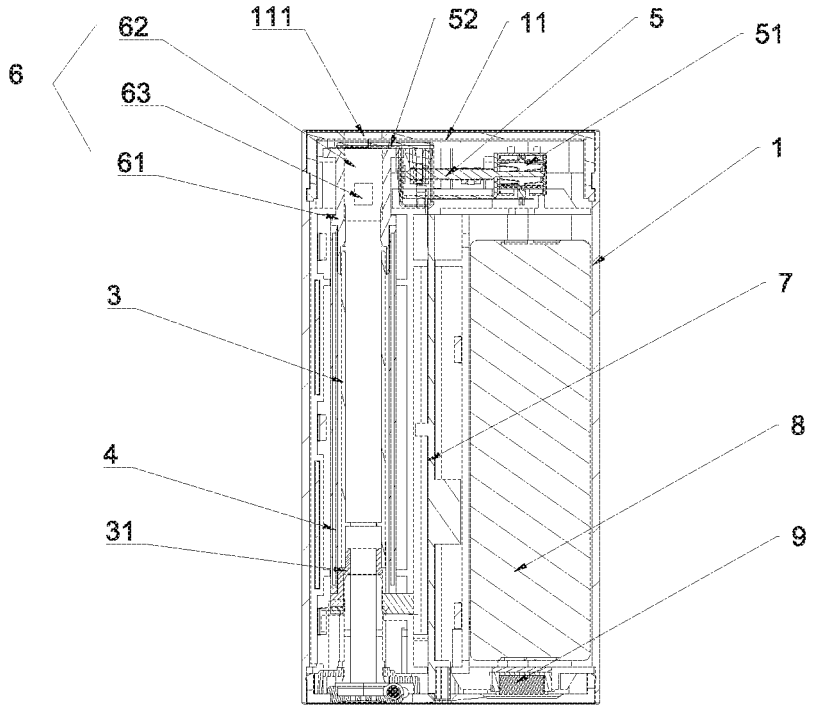
FIG. 1 is a cross-sectional view of a cigarette device according to an embodiment of the disclosure.

Herein, reference numerals of main components are as follows.

1. housing; 10. button hole; 11. housing lid; 111. cigarette insertion port; 12. support frame; 2. button; 21. button board; 22. LED indicator; 221. light zone; 3. heating tube; 31. tube base; 311. upper outer wall of tube base; 312. middle outer wall of tube base; 313. lower outer wall of tube base; 314. tube base opening; 4. heat-insulating tube; 5. automatic lid opening and/or closing mechanism; 51. drive motor; 52. cigarette insertion port lid; 6. cigarette detecting mechanism; 61. upper holder; 610. viewing window; 611. upper inner wall of upper holder; 612. lower inner wall of upper holder; 613. upper outer wall of upper holder; 614. lower outer wall of upper holder; 615. end shoulder; 616. middle shoulder; 62. detector circuit board; 63. detector; 7. intelligent control circuit board; 8. battery; 9. vibrator.

DETAILED DESCRIPTION OF ILLUSTRATED EMBODIMENTS

In order to make purposes, technical solutions and advantages of the disclosure clearer, the disclosure will be further explained in detail with reference to figures and embodiments described hereinafter.

EMBODIMENTS

The automatically controlled heat-not-burn electronic cigarette device of the disclosure is suitable for use with a dedicated cigarette which may generate tobacco smoke when being roasted at a temperature of approximately 200-320° C. The cigarette may comprise a cigarette body and a filter tip.

Figure 2:
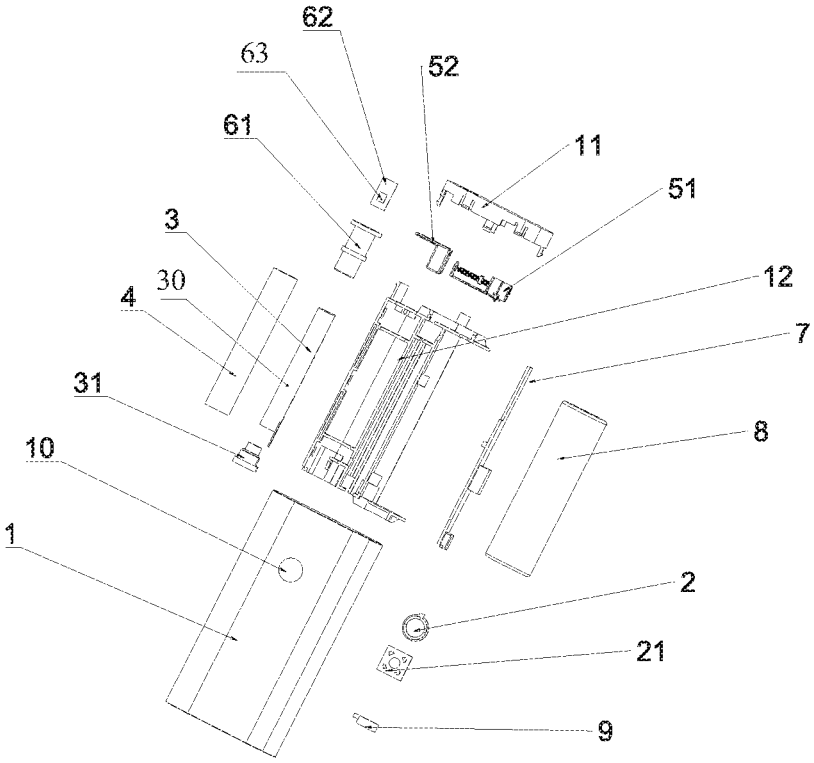
FIG. 2 is an exploded schematic view of a cigarette device according to an embodiment of the disclosure.
Figure 3:
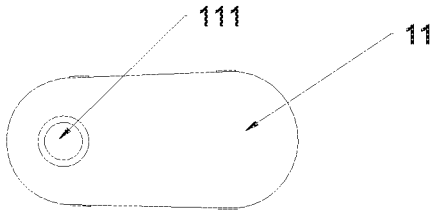
FIG. 3 is a top view of a housing lid according to an embodiment of the disclosure.

Referring to FIGS. 1, 2, and 3, an automatically controlled heat-not-burn electronic cigarette device of the disclosure comprises a housing 1, a button 2 provided at the housing 1, a housing lid 11, and a support frame 12 arranged in the housing 1. A heating tube 3 is mounted on the support frame 12, and a heat-generating conductor 30 is arranged in the heating tube 3, inside the wall of the tube. The housing lid 11 is provided with a cigarette insertion port 111, through which a cigarette may be inserted into the heating tube 3. An automatic lid opening and/or closing mechanism 5, which is arranged below the housing lid 11, comprises a cigarette insertion port lid 52 and a drive motor 51 for driving the cigarette insertion port lid 52 to move horizontally in order to open or close the cigarette insertion port 111. During using, the cigarette insertion port lid 52 is open to allow a cigarette to insert into the heating tube 3. When not in use, it is closed to prevent foreign matter from entering the heating tube 3. A heat-insulating tube 4 is sleeved outside the heating tube 3, with a gap formed therebetween. Due to the heat-insulating tube 4, heat insulating and heat keeping for the heating tube 3 is achieved. The heat-insulating tube 4 prevents heat radiation from the heating tube 3 to outside or radiating to any part outside the heat-insulating tube 4. The support frame 12 is further arranged with a cigarette detecting mechanism 6, an intelligent control circuit board 7, and a battery 8. The cigarette detecting mechanism 6 comprises an upper holder 61, a detector circuit board 62, and a detector 63 disposed on the detector circuit board 62.

Figure 9:
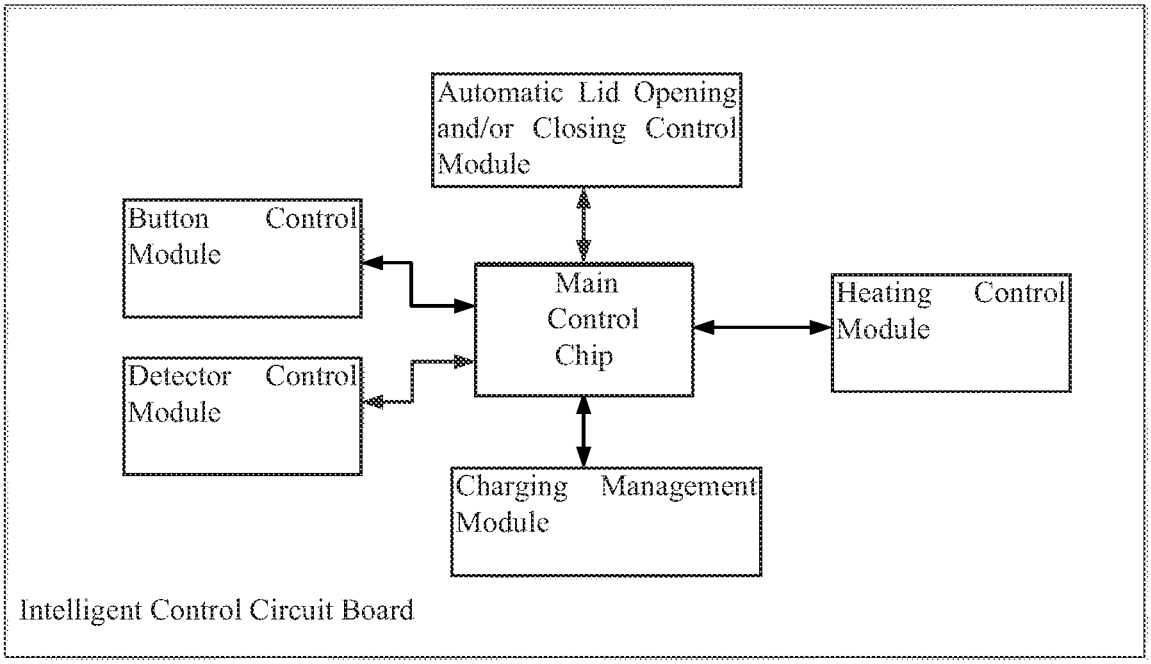
FIG. 9 is a schematic view illustrating an intelligent control circuit board according to an embodiment of the disclosure.

Referring to FIGS. 1, 2, and 9, the intelligent control circuit board 7 is arranged with a main control chip, a heating control module, an automatic lid opening and/or closing control module, a button control module, a detector control module, and a charging management module. Herein, the heating control module is electrically connected with the heat-generating conductor arranged in the heating tube 3, the automatic lid opening and/or closing control module is electrically connected with the drive motor 51, the button control module is electrically connected with the button 2, and the detector control module is electrically connected with the detector 63. When the electronic cigarette device is activated, the main control chip can control the electronic cigarette device to enter a smoking operation mode, or a sleep state, or an off state, on the basis of the determination of whether a cigarette is received in the heating tube 3 within a certain time.

Figure 4:
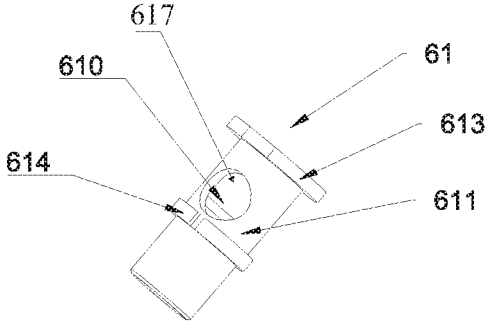
FIG. 4 is a perspective view of an upper holder according to an embodiment of the disclosure.
Figure 5:
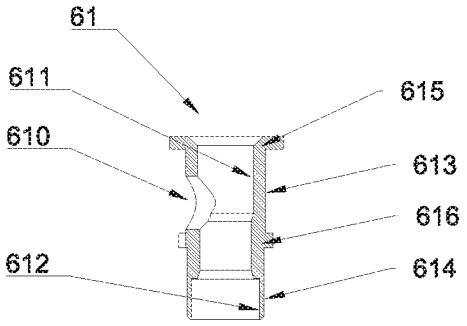
FIG. 5 is a cross-sectional view of an upper holder according to an embodiment of the disclosure.

Referring to FIGS. 4 and 5, the upper holder 61 is tube-shaped and is sleeved at an upper end of the heating tube 3 and is located below the cigarette insertion port 111. A cigarette may pass through the upper holder 61 and into the heating tube 3. A lower inner wall of upper holder 612 may abut an upper outer wall of the heating tube 3, and a lower outer wall of upper holder 614 may abut an upper inner wall of the heat-insulating tube 4. An upper wall of the upper holder 61 is provided with a viewing window 610. The viewing window 610 may be a circular through-hole. The detector 63 may be arranged outward of the viewing window 610, to detect whether a cigarette is received in the heating tube 3. The lower inner wall and the lower outer wall of the upper holder 61 are respectively sleeved on the heating tube 3 and the heat-insulating tube 4, to secure the upper ends of the heating tube 3 and the heat-insulating tube 4 against loosening. Thus, the heating tube 3 and the heat-insulating tube 4 are not in direct contact, and a gap can be formed between the heating tube 3 and the heat-insulating tube 4, thereby improving heat insulating and heat keeping effects.

In an embodiment of the disclosure, the viewing window 610 may be arranged with a transmissive window 617. The detector 63 may execute cigarette detection through the transmissive window. The transmissive window may be a transparent window, for example, a glazed window. The transmissive window which seals the viewing window 610 can prevent the smoke generated during using from flowing through the viewing window 610, flowing in the housing 1, the heating tube 3 and the heat-insulating tube 4, or flowing outside the upper holder 61. If the members, such as the automatic lid opening and/or closing mechanism 5 inside the housing 1, the cigarette detecting mechanism 6, the intelligent control circuit board 7 and the battery 8, are exposed to smoke for a long time, they may be contaminated and corroded and result in failures. In another embodiment, the above-mentioned transmissive window may be a non-transparent window, through which the detecting signal sent from the detector can pass so as to detect the cigarette inside the upper holder 61.

Referring to FIGS. 4 and 5, the upper inner wall 611 of the upper holder 61 has an inner diameter the same as an inner diameter of the heating tube 3, to allow the insertion of cigarette through the upper holder and into the heating tube. The lower inner wall 612 of the upper holder 61 has an inner diameter the same as an outer diameter of the heating tube 3, so that it can be sleeved on the heating tube 3 to achieve fixation. An end shoulder 615 is provided on the outer wall of the upper end of the upper holder 61. The end shoulder 615 may abut on the support frame 12, to achieve the positioning in axial direction and prevent upward and downward movements of the upper holder. A middle shoulder 616 is provided on the middle part of the outer wall of the upper holder 61. The outer wall below the middle shoulder 616 may be sleeved on the heat-insulating tube 4 and fixes the heat-insulating tube 4. The middle shoulder 616 may limit the heat-insulating tube 4 in axial direction and prevent axial displacement or movement of the heat-insulating tube 4. In this way, the heat-insulating tube 4 is prevented from being displaced to block the viewing window 610.

Figure 7:
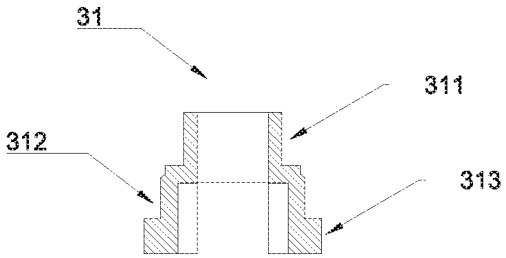
FIG. 7 is a cross-sectional view of a tube base according to an embodiment of the disclosure.
Figure 8:
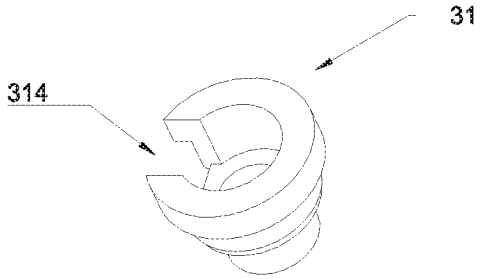
FIG. 8 is a perspective view of a tube base according to an embodiment of the disclosure.

Referring to FIGS. 7 and 8, a tube base 31 is further arranged at the lower part of the heating tube 3. The tube base 31 serves to fix the lower portions of the heating tube 3 and the heat-insulating tube 4. The tube base 31 is shaped as a hollow tube. The outer wall of the tube base 31 includes three parts of stepped outer walls: an upper outer wall of tube base 311, a middle outer wall of tube base 312 and a lower outer wall of tube base 313, which from top to bottom have inner diameters gradually increased in steps. Herein, the upper outer wall of tube base 311 may abut a lower inner wall of the heating tube 3, and the middle outer wall of tube base 312 may abut a lower inner wall of the heat-insulating tube 4. Herein, the lower outer wall of tube base 313 and the middle outer wall of tube base 312 are provided with an opening 314, through which a lead of the heat-generating conductor of the heating tube 3 can pass. In the embodiment, the tube base 31 is provided to fix the lower ends of the heating tube 3 and the heat-insulating tube 4. Thus, the gap can be formed between the heating tube 3 and the heat-insulating tube 4, and the heating tube 3 and the heat-insulating tube 4 are not in direct contact, thereby improving heat insulating and heat keeping effects.

In particular, in an embodiment of the disclosure, the detector 63 may be an infrared detector. In another embodiment, the detector 63 may be a photodetector of any other type.

In an embodiment of the disclosure, the heating tube 3 may be made of ceramic materials. The heat-generating conductor may be serpentine line shaped or spiral shaped, arranged on the wall of the heating tube 3, and made of the electric heating materials such as tungsten, graphite and graphene which generate heat when energized.

Figure 6:
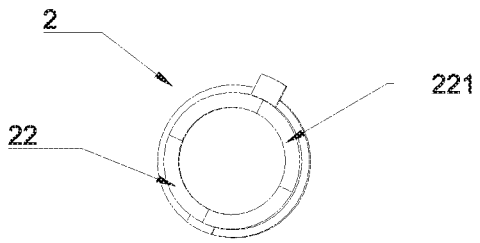
FIG. 6 is a perspective view illustrating a button and an LED indicator according to an embodiment of the disclosure.

Referring to FIGS. 1, 2 and 6, in an embodiment of the disclosure, the electronic cigarette device further comprises a vibrator 9 and an LED indicator 22. Herein, the vibrator 9 is configured to generate a vibration alert when the operational state of the electronic cigarette device is changed. The LED indicator 22 is arranged on the button 2, to indicate information such as the operational state of the electronic cigarette device or a remaining amount of the battery. The LED indicator 22 may comprise four segments of curved light zones 221. The four segments of curved light zones 221 may constitute a complete annular zone.

Figure 10:
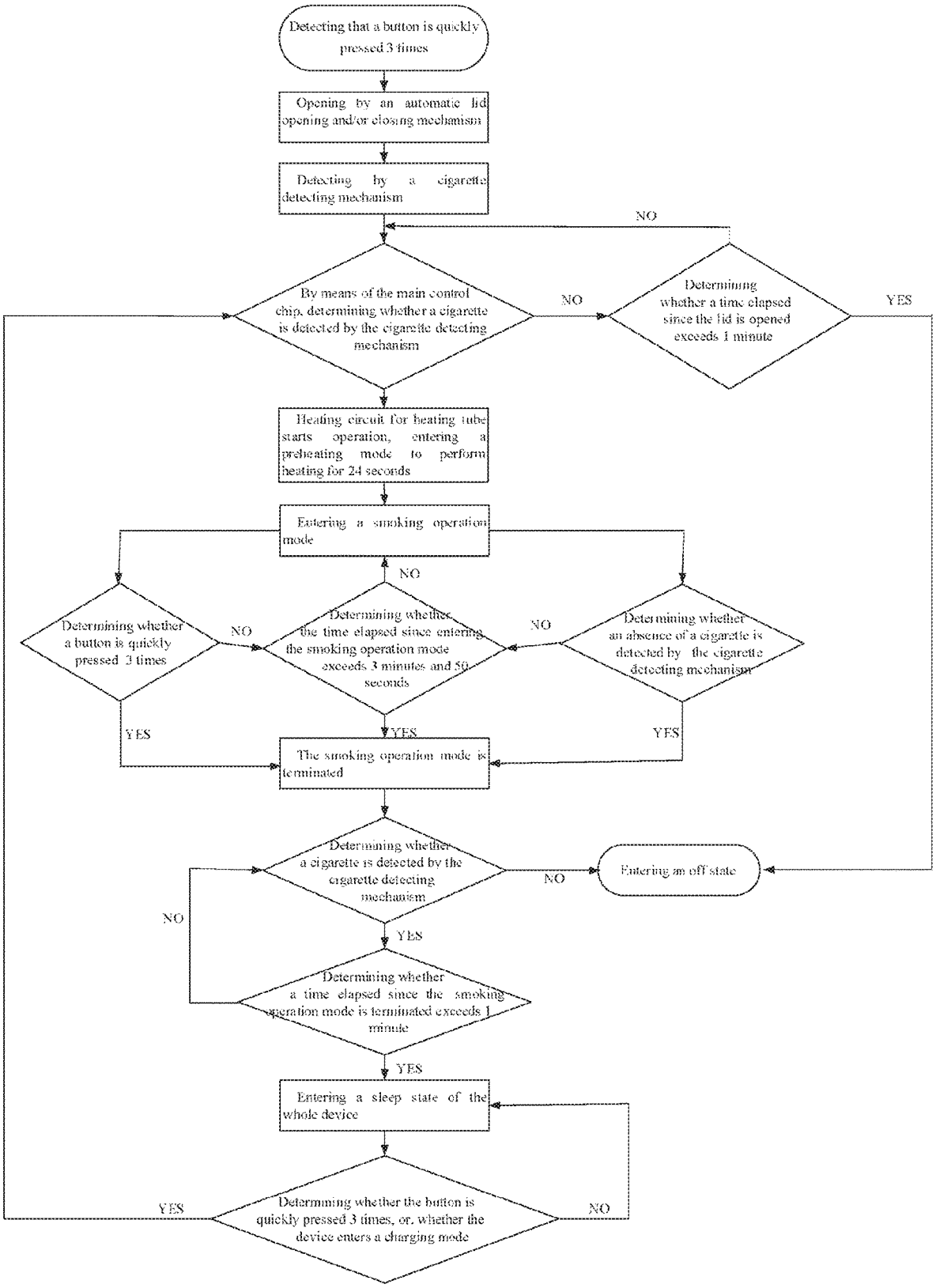
FIG. 10 is a flow diagram of a control method according to an embodiment of the disclosure.

Referring to FIGS. 1, 2, and 10, a method of controlling an automatically controlled heat-not-burn electronic cigarette device of the disclosure comprises steps of:

1. Receiving an activation signal of the electronic cigarette device by means of a main control chip when a button 2 is quickly pressed three times;

2. Sending, by means of the main control chip, a command to an automatic lid opening and/or closing control module, and opening, by means of the automatic lid opening and/or closing control module through an automatic lid opening and/or closing mechanism 5, a cigarette insertion port 111 to allow insertion of cigarette;

3. Sending a command by means of the main control chip through a detector control module to a detector 63, so as to detect whether a cigarette is received in a heating tube 3 and feedback a signal indicating whether a cigarette is received to the main control chip, hereafter, continuously detecting by the detector 63 until entering a sleep state or an off state;

4. Determining, by means of the main control chip, whether a cigarette is detected by the detector 63, if yes, go to step 6; if no, go to next step;

5. Determining, by means of the main control chip, whether the time elapsed since the cigarette insertion port is opened by means of the automatic lid opening and/or closing mechanism 5 exceeds one minute, if no, go back to step 4; if yes, go to step 15;

6. Sending a command to a heating control module by means of the main control chip, and controlling, by means of the heating control module, the heating tube 3 to enter a preheating mode and perform quick heating for 24 seconds;

7. Controlling, by means of the heating control module, the heating tube 3 to enter a smoking operation mode, in which the heating tube 3 performs heating to maintain constant temperature and the device is available for smoking operation;

8. In the smoking operation mode, by means of the main control chip, determining whether the button 2 is quickly pressed three times, or determining whether an absence of a cigarette is detected by the detector 63, if yes, go to step 10; if no, go to next step;

9. Determining, by means of the main control chip, whether the time elapsed since entering the smoking operation mode exceeds three minutes and fifty seconds, if no, go back and continue step 7;

10. Sending, by means of the main control chip, a stopping command to stop the smoking operation mode, and controlling, by means of the heating control module, the heating tube 3 to stop heating;

11. Determining, by means of the main control chip, whether a cigarette is detected by the detector 63, if yes, go to next step; if no, go to step 15;

12. Determining, by means of the main control chip, whether the time elapsed since the smoking operation mode is stopped exceeds one minute, if no, go back to previous one step; if yes, go to next step;

13. Sending a sleep command by means of the main control chip, and entering a sleep state of the whole device, in which the automatic lid opening and/or closing mechanism 5 is in a state of keeping the heating tube open, and the main control chip and all circuits are deactivated;

14. Determining whether the button 2 is quickly pressed three times, or, whether the whole device enters a charging mode, if yes, reactivate the whole device and go to step 4; if no, go back to step 13;

15. Entering an off state, in which the heating tube 3 is closed by means of the automatic lid opening and/or closing mechanism 5, and the main control chip and all circuits are deactivated.

Referring to FIGS. 1, 2, 6, and 10, in a method of controlling an electronic cigarette device of the disclosure according to another embodiment on the basis of the above embodiment, the electronic cigarette device further comprises a vibrator 9 and comprises an LED indicator 22 arranged on an outer circumference of the surface of the button. The LED indicator 22 may comprise an annular zone which comprises four segments of curved light zones 221. The step 7 and the step 10 may further comprise: providing short vibration for informing a user by means of the vibrator 9. The step 2 may further comprise: lighting segments of the annular zone of the LED indicator 22 in a circular manner, to inform a user it is ready to receive a cigarette. The step 6 may further comprise: on the basis of preheating time progress, lighting the four segments of curved light zones of the LED indicator 22 one by one, to inform a user of the preheating progress. The step 7 may further comprise: continuously lighting the annular zone of the LED indicator 22, to inform a user of entering the smoking operation mode.

The step 10 may further comprise: lighting in a circular manner and then un-lighting segments of the annular zone of the LED indicator 22, to inform a user that the smoking operation mode is terminated.

The step 13 may further comprise: blinking twice and then un-lighting the annular zone of the LED indicator, to inform a user of entering the sleep mode.

In another embodiment, the number of times that the button is pressed and the determination period in the steps of the above mentioned control method may be modified to other various values.

INDUSTRIAL APPLICABILITY

All the above are merely preferred embodiments of the disclosure. The present invention is intended to cover all equivalent arrangements and modifications included within the scope of the invention.

The invention claimed is:

1. An automatically controlled heat-not-burn electronic cigarette device, characterized in that, the device comprises: a housing, a housing lid and a heating tube arranged in the housing, a heat-insulating tube sleeved outside the heating tube, an automatic lid opening and/or closing mechanism, a cigarette detecting mechanism, an intelligent control circuit board, a button, and a battery; wherein the housing lid is provided with a cigarette insertion port, the automatic lid opening and/or closing mechanism is arranged below the housing lid and comprises a cigarette insertion port lid and a drive motor for driving the cigarette insertion port lid to open or close the cigarette insertion port, the cigarette detecting mechanism comprises an upper holder, a detector circuit board, and a detector disposed on the detector circuit board, the upper holder is tube-shaped and is sleeved at an upper end of the heating tube and is located below the cigarette insertion port, a lower inner wall of the upper holder abuts an upper outer wall of the heating tube, and a lower outer wall of the upper holder abuts an upper inner wall of the heat-insulating tube, an upper wall of the upper holder is provided with a viewing window, the detector is arranged outward of the viewing window to detect whether a cigarette is received in the heating tube, wherein the intelligent control circuit board is arranged with a main control chip, a heating control module, an automatic lid opening and/or closing control module, a button control module, a detector control module, and a charging management module, wherein the heating control module is electrically connected with the heating tube, the automatic lid opening and/or closing control module is electrically connected with the drive motor, the button control module is electrically connected with the button, and the detector control module is electrically connected with the detector, the main control chip is configured to control the electronic cigarette device to enter a smoking operation mode, or a sleep state, or an off state, on the basis of a determination of whether a cigarette is received in the heating tube within a certain time.

2. The automatically controlled heat-not-burn electronic cigarette device according to claim 1, characterized in that, the viewing window comprises a transmissive window for sealing the viewing window, and the detector is capable of detecting a cigarette through the transmissive window.

3. The automatically controlled heat-not-burn electronic cigarette device according to claim 1, characterized in that, an upper inner wall of the upper holder has an inner diameter the same as an inner diameter of the heating tube, and the lower inner wall of the upper holder has an inner diameter the same as an outer diameter of the heating tube, an end shoulder is provided on an outer wall of an upper end of the upper holder, a middle shoulder is provided on an outer wall of a middle part of the upper holder, and an outer wall below the middle shoulder is sleeved on the heat-insulating tube.

4. The automatically controlled heat-not-burn electronic cigarette device according to claim 1, characterized in that, a heat-generating conductor is arranged inside a wall of the heating tube, the heating tube is made of ceramic material, the heat-generating conductor is serpentine line shaped or spiral shaped, and made of tungsten, graphite or graphene material arranged inside the wall of the heating tube.

5. The automatically controlled heat-not-burn electronic cigarette device according to claim 1, characterized in that, the detector is an infrared detector.

6. The automatically controlled heat-not-burn electronic cigarette device according to claim 1, characterized in that, further comprising a vibrator configured to generate a vibration alert when an operational state of the electronic cigarette device is changed.

7. The automatically controlled heat-not-burn electronic cigarette device according to claim 1, characterized in that, an LED indicator is arranged on an outer circumference of a surface of the button, the LED indicator is configured to indicate information such as an operational state of the electronic cigarette device or a remaining amount of the battery, the LED indicator comprises four segments of curved light zones, and the four segments of curved light zones constitutes a complete annular zone.

8. A method of controlling an automatically controlled heat-not-burn electronic cigarette device according to claim 1, characterized in that, the method comprises steps of:

(1) receiving an activation signal by means of a main control chip when a button is quickly pressed N1 time;

(2) sending a command to an automatic lid opening and/or closing control module by means of the main control chip, and opening a cigarette insertion port to allow insertion of cigarette by means of the automatic lid opening and/or closing control module through an automatic lid opening and/or closing mechanism;

(3) sending a command to a detector by means of the main control chip, and by means of the detector, detecting whether a cigarette is received in a heating tube and feeding back a signal indicating whether a cigarette is received to the main control chip, hereafter, continuously detecting by means of the detector until entering a sleep state or an off state;

(4) determining, by means of the main control chip, whether a cigarette is detected by the detector, if yes, go to step 6; if no, go to next step;

(5) determining, by means of the main control chip, whether a time elapsed since the cigarette insertion port is opened exceeds T1 minute, if no, go back to step 4; if yes, go to step 15;

(6) sending a command to a heating control module by means of the main control chip, and by means of the heating control module, controlling the heating tube to enter a preheating mode and perform quick heating for T2 second;

(7) controlling, by means of the heating control module, the heating tube to enter a smoking operation mode, in which the heating tube performs heating to maintain constant temperature and the device is available for smoking operation;

(8) in the smoking operation mode, by means of the main control chip, determining whether the button is quickly pressed N2 time, or determining whether an absence of a cigarette is detected by the detector, if yes, go to step 10; if no, go to next step;

(9) determining, by means of the main control chip, whether a time elapsed since entering the smoking operation mode exceeds T3 second, if no, go back and continue step 7;

(10) sending, by means of the main control chip, a stopping command to stop the smoking operation mode, and controlling, by means of the heating control module, the heating tube to stop heating;

(11) determining, by means of the main control chip, whether a cigarette is detected by the detector, if yes, go to next step; if no, go to step 15;

(12) determining, by means of the main control chip, whether a time elapsed since the smoking operation mode is stopped exceeds T4 minute, if no, go back to previous one step; if yes, go to next step;

(13) sending a sleep command by means of the main control chip, and entering a sleep state of the whole device, in which the automatic lid opening and/or closing mechanism is in a state of keeping the heating tube open, and the main control chip and all circuits are deactivated;

(14) determining whether the button is quickly pressed N3 time, or, whether the whole device enters a charging mode, if yes, reactivate the whole device and go to step 4; if no, go back to step 13;

(15) entering an off state, in which the heating tube is closed by means of the automatic lid opening and/or closing mechanism, and the main control chip and all circuits are deactivated.

9. The method of controlling the automatically controlled heat-not-burn electronic cigarette device according to claim 8, characterized in that, in the steps, N1, N2, N3 (the times that the button is quickly pressed) is three, T1 is 1 minute, T2 is 24 seconds, T3 is 3 minutes and 50 seconds, and T4 is one minute.

10. The method of controlling the automatically controlled heat-not-burn electronic cigarette device according to claim 8, characterized in that, the electronic cigarette device further comprises a vibrator and comprises an LED indicator arranged on an outer circumference of a surface of the button, the LED indicator has an annular zone which comprises four segments of curved light zones, the step 7 and the step 10 further comprises: providing short vibration for informing a user by means of the vibrator, the step 2 further comprises: lighting segments of the annular zone of the LED indicator in a circular manner, to inform a user the device is ready to receive a cigarette;

the step 6 further comprises: on the basis of preheating time progress, lighting the four segments of curved light zones of the LED indicator one by one, to inform a user of the preheating progress;

the step 7 further comprises: continuously lighting the annular zone of the LED indicator, to inform a user of entering the smoking operation mode;

the step 10 further comprises: lighting in a circular manner and then un-lighting segments of the annular zone of the LED indicator, to inform a user that the smoking operation mode is terminated;

the step 13 further comprises: blinking twice and then un-lighting the annular zone of the LED indicator, to inform a user of entering the sleep mode.

* * * * *